United States Patent [19]

Kler

[11] Patent Number: 4,926,088

[45] Date of Patent: May 15, 1990

[54] IGNITERS AND METHODS OF MANUFACTURE OF IGNITERS

[75] Inventor: Chandra M. Kler, Wembley, England

[73] Assignee: Smiths Industries Public Limited Company, London, England

[21] Appl. No.: 278,992

[22] Filed: Dec. 2, 1988

[30] Foreign Application Priority Data

Dec. 5, 1987 [GB] United Kingdom ..... 8728492

[51] Int. Cl.[5] ..... H01T 13/20; H01T 21/02

[52] U.S. Cl. ..... 313/131 A; 313/141; 445/7

[58] Field of Search ..... 313/141, 142, 131 A; 445/7

[56] References Cited

U.S. PATENT DOCUMENTS 3,958,144 5/1976 Franks ..... 313/141 X
3,984,717 10/1976 Romanowski et al. ..... 313/141
3,995,184 11/1976 Insley ..... 313/131 A
4,081,710 3/1978 Heywood et al. ..... 313/141
4,853,582 8/1989 Sato et al. ..... 313/141

*Primary Examiner*—Kenneth Wieder
*Attorney, Agent, or Firm*—Pollock, Vande Sande and Priddy

[57] ABSTRACT

An electrical igniter has an outer shell with a tungsten forward end which forms an annular outer electrode. A central rod extends axially within the shell and has a tungsten forward end forming an inner electrode which is separated from the outer electrode by a semiconductive surface discharge path. The inner and outer electrodes both have chromium diffused into the tungsten to form surface layers that are oxidation resistant at high temperatures. The electrodes are made by placing the tungsten forward ends in a furnace in a chromium rich atmosphere between 1000 and 1200 degrees Centrigrade for between 10 to 24 hours and allowing them to cool in the furnace. Chromium is removed from the rear ends of the tungsten parts before joining them to the rear parts of the electrodes which are of different metals.

12 Claims, 1 Drawing Sheet

IGNITERS AND METHODS OF MANUFACTURE OF IGNITERS

BACKGROUND OF THE INVENTION

This invention relates to igniters and to methods of manufacture of igniters.

The invention is more particularly concerned with igniters having a tungsten tip.

Igniters used in high temperature applications, such as in gas-turbine engines, are prone to excessive electrical erosion. In order to keep this erosion to a minimum, the tips of such igniters are generally made of tungsten. This helps to prolong the life of the igniter to a certain extent, but the igniter tip can still oxidize and erode away rapidly at high temperatures, leading to a loss in reliability and to a high cost of replacement. Oxidation of the electrodes can lead to a dimensional increase in size of the electrode with consequent fracture of, for example, a semiconductor discharge pellet, or insulation between the electrodes.

SUMMARY OF THE INVENTION

It is an object of the present invention to provide an igniter and a method of manufacture of an igniter that has improved resistance to the effects of high temperature oxidation and electrical erosion.

According to one aspect of the present invention there is provided an electrical igniter having two electrodes spaced from one another at the operative tip of the igniter to provide a gap across which discharge is produced, at least one of the electrodes being substantially of tungsten and having a surface layer into which chromium has been diffused to provide a surface that is oxidation resistant at high temperatures.

Preferably both electrodes are substantially of tungsten and have a surface layer into which chromium has been diffused.

The igniter may include a semiconductive surface discharge path between the two electrodes. A first of the electrodes may be of annular form and a second of the electrodes may be located centrally within the first electrode. The first electrode may be provided at one end of a metal outer shell of the igniter, the second electrode being provided at one end of a metal rod extending axially within the outer shell. The forward end of the outer shell may be of tungsten and the rear end of the outer shell of a metal different from tungsten, such as stainless steel. The forward end of the metal rod may be of tungsten and the rear end of the metal rod of a metal different from tungsten, such as a nickel alloy.

According to another aspect of the present invention there is provided a method of forming a high-temperature, oxidation resistant electrode for an igniter comprising the steps of providing an electrode of tungsten, and diffusing chromium into a surface layer of the electrode so as thereby to produce an oxidation-resistant surface.

The electrode may be placed in a furnace in a chromium rich atmosphere at elevated temperature such as between 1000 to 1200 degrees Centigrade for between about 10 to 24 hours. The electrode may be allowed to cool in the furnace. The electrode may be subsequently joined to a metal other than tungsten in which case chromium is preferably removed from a region of the electrode that is joined to the other metal.

An igniter with tungsten electrodes, and a method of treating the electrodes will now be described, by way of example, with reference to the accompanying drawings.

DETAILED DESCRIPTION OF THE PREFERRED EMBODIMENT

Figure 1:
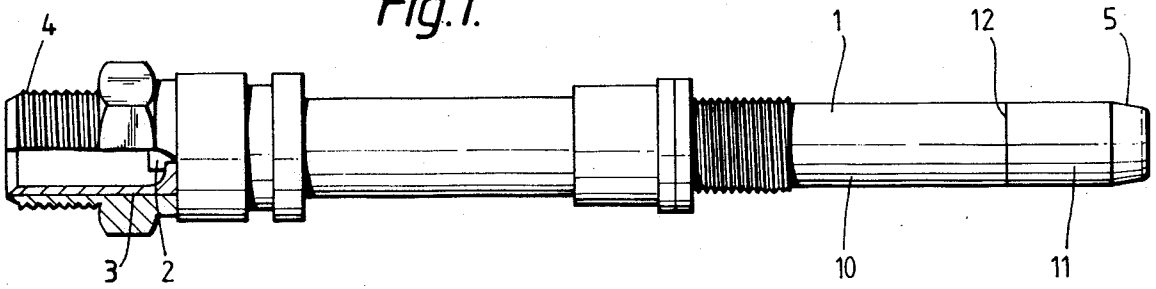
FIG. 1 is a partly sectional side elevation view of the igniter.
Figure 2:
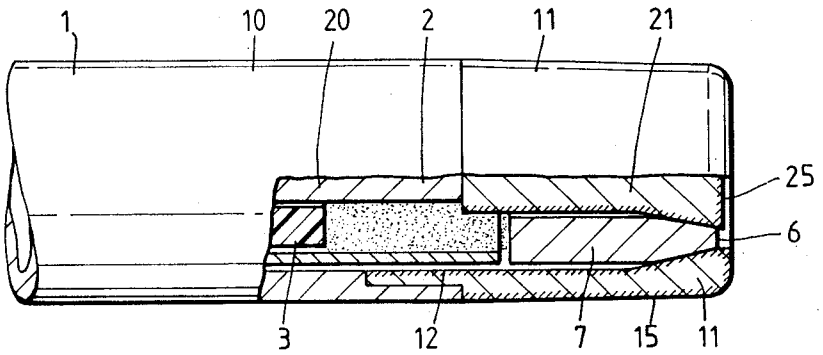
FIG. 2 is an enlarged sectional view of the operative tip of the igniter.

The igniter has a tubular outer metal shell 1 within which a central metal rod 2 extends axially, the central rod being insulated from the outer shell along its length by a ceramic sleeve 3. The forward end of the outer metal shell 1 provides an outer, annular electrode, and the forward end of the rod 2 provides an inner electrode of the igniter.

At the rear end 4 of the igniter, the outer metal shell 1 and central electrode 2 are shaped, in the usual way, to receive an electrical connector (not shown), by which electrical connection is established with the igniter. At the forward operative end 5 of the igniter, the central electrode 2 is separated from the outer shell 1 by a semiconductive surface 6 provided by the flat, annular end surface of a tubular pellet 7 of silicon carbide. Application of a voltage between the central electrode 2 and the outer shell 1, at the rear end, causes an electrical discharge between the two electrodes at the operative tip, over the semiconductive surface 6.

The outer shell 1 is formed in two parts; a rear part 10 of stainless steel or a nickel alloy, such as Nimonic 75, and a forward part 11 of tungsten. The rear end 12 of the forward part 11 is brazed to the rear part 10, the forward end of the forward part providing the outer electrode of the igniter. Tungsten is used for the forward end of the igniter because it is more resistant to electrical erosion than nickel or stainless steel alloys. The central electrode 2 is similarly formed in two parts: a rear end 20 of a nickel alloy, such as Nilo-K, and a forward end 21 of tungsten.

Conventional tungsten electrodes are resistant to oxidation for useful periods up to about 650 degrees C.

The tungsten electrodes formed by the forward parts 11 to 21, in the present igniter are treated to be resistant to oxidation at higher temperatures by forming the electrodes with a diffused surface layer 15 and 25 respectively of chromium. This has been found to extend the temperature range of the igniter up to about 750 degrees Centigrade. By reducing oxidation, the consequent increase in size of the electrodes is reduced. In this way, any increase in radial dimension of the central electrode 2 is kept to a minimum, thereby reducing the risk of fracture of the semiconductor pellet 7. This reduces the need to remove and replace failed igniters. Because the igniter is resistant to higher temperatures, it gives the engine designer greater freedom in the choice of location of the igniter, enabling it to be located in regions where conventional igniters would be rapidly eroded.

The diffused surface layer 15, 25 of chromium is preferably produced prior to joining the forward tungsten parts 10 and 20 to the rear parts 11 and 21. The tungsten components 10 and 20 are cleaned and placed in a furnace with a chromium rich atmosphere and their temperature is raised to between about 1000 and 1200 degrees Centigrade. The tungsten components are maintained at this temperature for between ten to twenty four hours until sufficient chromium has diffused into the surface layer of tungsten for the particular application to which the igniter is to be put.

The tungsten components 10 and 20 are allowed to cool and then removed from the furnace. The rear end of the components are then polished to remove the chromium layer and enable them to be welded to the rear parts 10 and 20 of the outer and inner electrodes.

It will be appreciated that other ways of diffusing chromium into the tungsten electrode tips could be used. Also, the tips could be diffused with chromium after welding to the rear parts 11 and 21 of the igniter.

The invention could be applied to spark-gap igniters as well as to surface-discharge igniters.

What is claimed is:

1. An electrical igniter of the kind having two electrodes and means spacing the two electrodes from one another at the operative tip of the igniter to provide a gap across which discharge is produced, the improvement wherein at least one of said electrodes is substantially of tungsten except for a surface layer that has been treated to be oxidation resistant at high temperatures by diffusion of chromium into the surface layer.

2. An electrical igniter according to claim 1, wherein both said electrodes are substantially of tungsten and have a surface layer into which chromium has been diffused.

3. An electrical igniter according to claim 1 including means for providing a semconductive surface discharge path between the two electrodes.

4. An electrical igniter according to claim 1, wherein a first of the said electrodes is of annular form and wherein the igniter includes means locating a second of the electrodes centrally within the first electrode.

5. An electrical igniter according to claim 4, including a metal outer shell of the igniter, a metal rod and means mounting the metal rod to extend axially within the outer shell, wherein said first electrode is provided at one end of said outer shell and the second electrode is provided at one end of said metal rod.

6. An electrical igniter according to claim 5, wherein the forward end of the outer shell is of tungsten and the rear end of the outer shell is a metal different from tungsten.

7. An electrical igniter according to claim 5, wherein the forward end of the metal rod is of tungsten and the rear end of the metal rod is of a metal different from tungsten.

8. A method of forming a high-temperature, oxidation-resistant electrode for an igniter comprising the steps of forming an electrode of tungsten and then diffusing chromium into a surface layer of the electrode so as thereby to produce an oxidation-resistant surface.

9. A method according to claim 8 wherein said diffusing step is effected by placing the electrode in a furnace in a chromium rich atmosphere at elevated temperature.

10. A method according to claim 9, wherein the electrode is placed in a furnace between about 1000 to 1200 degrees Centigrade for between about 10 to 24 hours.

11. A method according to claim 8, wherein the electrode is subsequently joined to a metal other than tungsten.

12. A method according to claim 11, wherein chromium is removed from a region of the electrode that is joined to the other metal prior to joining the electrode to the other metal.

* * * * *